United States Patent [19]

Miley

[11] 3,943,515

[45] Mar. 9, 1976

[54] COUNTER-COUNTERMEASURE GUIDANCE SYSTEM

[75] Inventor: Frank P. Miley, Camarillo, Calif.

[73] Assignee: The United States of America as represented by the Secretary of the Navy, Washington, D.C.

[22] Filed: Apr. 24, 1962

[21] Appl. No.: 190,527

[52] U.S. Cl. ..... 343/18 E; 325/59

[51] Int. Cl.[2] ..... H04K 3/00

[58] Field of Search..... 343/18, 17.1, 100, 18 E; 325/59, 40, 47

[56] References Cited

UNITED STATES PATENTS 3,806,925 4/1974 Cuthbert ..... 343/18 E

*Primary Examiner*—Malcolm F. Hubler

*Attorney, Agent, or Firm*—Richard S. Sciascia; J. M. St.Amand; E. F. Johnston

EXEMPLARY CLAIM

4. A method of avoiding countermeasure jamming techniques comprising the steps of:

transmitting a signal over at least a pair of carrier waves which differ in frequency by a predetermined amount and receiving and beating the carrier waves one against the other to obtain an intermediate frequency wave having an envelope of said signal, whereby jamming either carrier wave will enhance the effect of said beating to increase the amplitude of the signal, thus defeating the purpose of said jamming.

6 Claims, 3 Drawing Figures

INVENTOR.
FRANK P. MILEY

BY Erwin A. Johnston
George J. Rubens
ATTORNEYS

COUNTER-COUNTERMEASURE GUIDANCE SYSTEM

The invention described herein may be manufactured and used by or for the government of the United States of America for governmental purposes without the payment of any royalties thereon or therefor.

The present invention relates to a counter-countermeasure guidance system and, more particularly, to a guidance system which will counter the effect of enemy jamming when a command signal is transmitted from a transmitter station to a receiver station.

In the past, enemy jamming of a carrier wave carrying the signal between a transmitter station and a receiving station has been very effective in that the jamming noise has disguised the signal to such an extent that it cannot be discerned by the receiving station. Previously, the signal has been transmitted over a single carrier wave to the receiving station where it is mixed in a conventional manner in a mixer with the local oscillator signal. The present invention eliminates the need of a local oscillator as well as any automatic frequency control circuit in a unique manner. The present invention transmits a single command signal from the transmitter station over two different carrier waves which differ in their frequency by a predetermined amount, this difference being the intermediate frequency of the receiver. These two carrier waves which have been modulated by the desired command signal are received by the receiver station and are beat one against the other in a mixer to obtain an intermediate frequency having the envelope of the desired signal. As shown in FIG. 2, should an enemy station jam either one of the carrier waves transmitted from the aircraft the beating effect in the mixer of the receiver will be enhanced so that the amplitude of the intermediate frequency will be greater, thus increasing the amplitude of the desired signal. Therefore, it can be seen that upon either carrier wave being jammed, the desired signal will be increased, thus defeating the purpose of the jamming procedures. Further, by eliminating the local oscillator and the automatic frequency control in the receiver the weight and the complixity of the receiver will be decreased, thus increasing the efficiency of the overall system.

An object of the present invention is to provide a system for transmitting a signal from a transmitter station to a receiver station without any decrease in the discernibility of the signal due to jamming techniques which may be effected.

A further object of the invention is to increase the strength of a signal at a receiver station when a carrier wave carrying the signal has been jammed on its carrier frequency.

Still another object is to provide a system for effectively commanding a missile in its trajectory, even though a carrier wave carrying a command signal has been jammed by an enemy station.

Yet another object is to eliminate the need of a local oscillator and an automatic frequency control circuit in a receiver at a receiving station.

A still further object is to reduce the weight and increase the efficiency within a receiver station receiving command signals.

Other objects and many of the attendant advantages of this invention will be readily appreciated as the same becomes better understood by reference to the following detailed description when considered in connection with the accompanying drawing in which like reference numerals designate like parts throughout the figures thereof and wherein.

Figure 1:
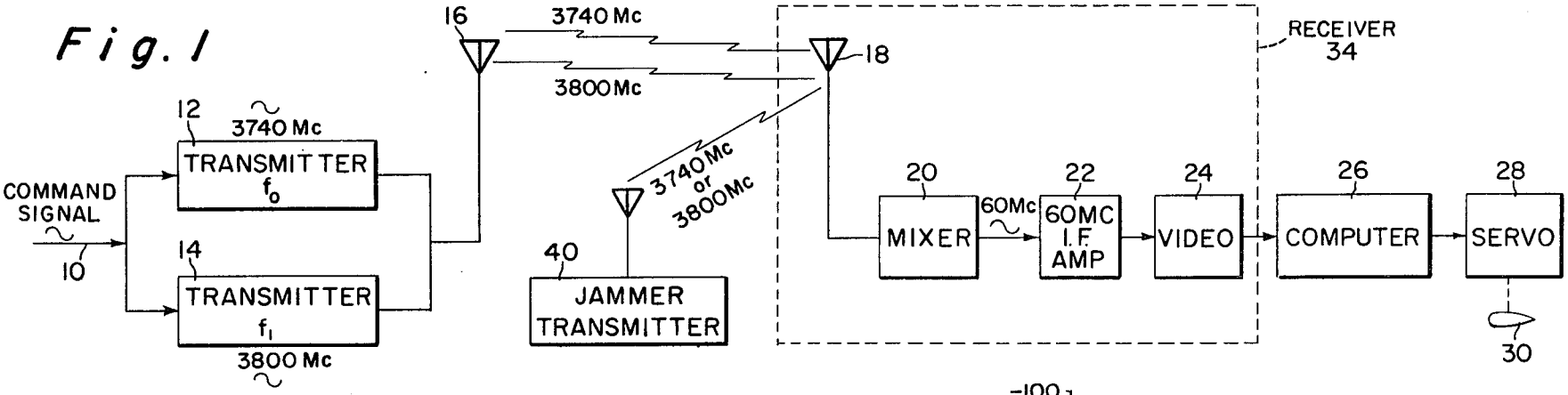
FIG. 1 is a diagrammatic view showing the circuitry of one embodiment of the invention.

Referring now to the drawings, wherein like reference numerals designate like or corresponding parts throughout the several views, there is shown in FIG. 1 a lead 10 for feeding a command signal to a pair of transmitters 12 and 14, the transmitter 12 generating a carrier frequency and modulating it by the signal to obtain a modulated carrier wave $f_0$ and the transmitter 14 generating a carrier frequency and modulating it by the same signal to obtain a modulated carrier wave $f_1$. The carrier waves $f_0$ and $f_1$ differ in their frequency by a predetermined amount, such as 60 megacycles as shown in FIG. 1 with the frequency of $f_0$ being 3740 mc and the frequency of $f_1$ being 3,800 mc. Both of the carrier waves carry the command signal and are transmitted from an antenna 16 to a receiving antenna 18.

Both of the modulated carrier waves are fed from the antenna 18 to a mixer 20, where the carrier waves are beat one against the other so as to simulate the operation of a local oscillator and a first detector within a superhetrodyne receiver. The output of the mixer is an intermediate frequency wave which is the difference in frequencies between the two carrier waves and for the embodiment as shown in FIG. 1 will be 60 megacycles, this intermediate frequency wave carrying an envelope of the command signal. The intermediate frequency wave is fed to an intermediate frequency amplifier 22. After the intermediate frequency wave has been amplified, the signal is sent to a video circuit 24 to detect the signal in a useful form for a computer 26. The computer is programmed in such a way so as to send a usable signal to a servo 28 which, in turn, mechanically operates control vanes 30 of a missile 32. For convenience purposes the antenna 18, the mixer 20, the I.F. amplifier 22, and the video circuit 24 are shown generally as a receiver 34.

Figure 2:
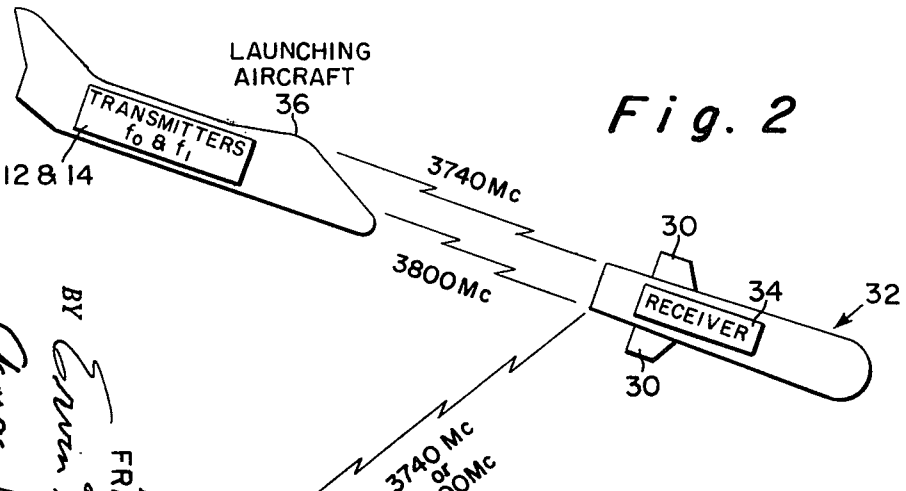
FIG. 2 is a diagrammatic view of the embodiment of the invention in operation.

In the operation of the system FIG. 2 shows a launching aircraft 36 which has just launched the missile 32 against a target 38, the launching aircraft carrying the transmitters 12 and 14 and the missile 32 carrying the receiver 34. The aircraft 36 is transmitting a command signal over the pair of carrier waves to the receiver 34 and simultaneously an enemy jammer transmitter 40 is transmitting a jamming signal over a carrier wave which may be identical in frequency to either one of the carrier waves transmitted from the aircraft 36. The result is that when one of the carrier waves from the launching aircraft is jammed, its amplitude will be increased at the receiver 34, while the command signal on the other carrier wave remains unaffected. Because of this increase in amplitude of the one carrier wave as received in the mixer 20, the beating effect against the other carrier will be enhanced so as to cause the intermediate frequency wave to have a greater amplitude, thus resulting in the envelope of the command signal on the intermediate frequency wave to also be at a greater amplitude. Accordingly, because of the jamming tactics employed by the jamming station 40 the command signal has actually been increased at the receiver 34, thus defeating the purpose of the jammer transmitter

40.

Figure 3:
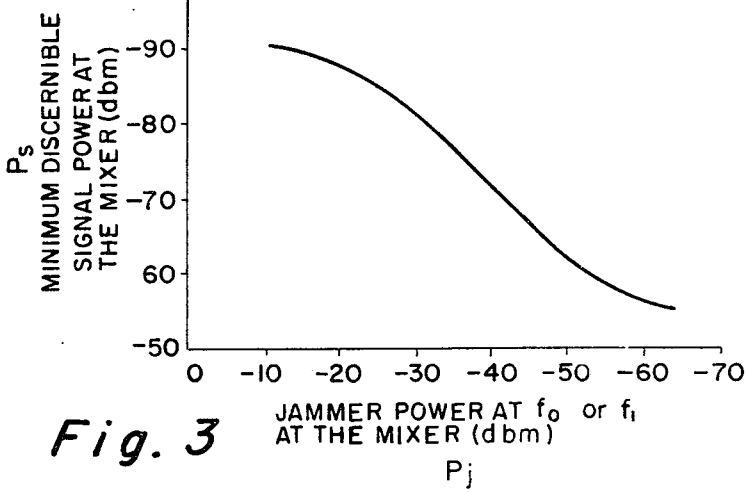
FIG. 3 is a chart showing the results obtained from the invention when either carrier wave is jammed.

The effect of jamming either one of the carrier waves is illustrated in FIG. 3 wherein the jammer power on either frequency $f_0$ or $f_1$ in dbm at the mixer is plotted versus the minimum discernible signal power in dbm also at the mixer. Each of these powers is reduced to decibels per milliwatts by the following formulas:

$$P_j\ (dbm) = 10 \log_{10} \frac{P_j}{10-3}$$

where $P_j$ $(dbm)$ = the jammer power in dbm at the mixer and $P_j$ = the jammer power at the mixer in watts and $$P_s\ (dbm) = 10 \log_{10} \frac{P_s}{10-3}$$

where $P_s$ $(dbm)$ = the minimum discernible signal power in dbm at the mixer and $P_s$ = the minimum discernible signal power at the mixer in watts. As shown by the curve in FIG. 3, as the jammer power is increased (from right to left) the minimum discernible signal power at the mixer likewise increases, thus defeating the purpose of the enemy in jamming either wave. Should the enemy transmit a jamming signal which is at a frequency midway between the two carrier frequencies shown in FIG. 2 (namely a frequency of 3,770 mc), the curve shown in FIG. 3 would have a flat response until the jammer power reached an unpractical value of about −20 dbm, after which upon an increase of jammer power the signal power would correspondingly decrease. Any other jamming frequency chosen by the enemy other than the midfrequency between the two carrier waves would result in an improved signal over the flat response curve just mentioned. The system remains efficient even though the enemy should jam both of the carrier waves transmitted from the launching aircraft 34. Since the noise directed at each carrier wave will add and subtract from one another in the mixer to show its incoherency the mixing of the two carrier waves will add the command signal on each wave to one another, thus adding to the coherency of the command signal. Accordingly, it will be apparent that the coherent command signal will be readily discernible over the incoherent noise signal in the mixer.

While the invention as shown in FIGS. 1 and 2 is utilized for commanding a missile from a launching aircraft, it is to be understood that the invention may be used in many other embodiments. For instance, the invention may be used for commanding other missiles than air-to-ground, such as air-to-air missiles or ground-to-air missiles and the invention could be used merely in transmitting information from one ground transmitter station to another ground receiver station. While only a pair of transmitters 12 and 14 are shown in the embodiment of FIG. 1, it is to be understood that any number (not less than two) could be used. For instance, three or four transmitters could be used which would enhance the system even more. Further, it is not necessary that the transmitters 12 and 14 transmit carrier waves having the frequencies as shown in FIG. 1 since it is only necessary that the carrier frequencies have a frequency differential of some amount. While the command signal in FIG. 1 is shown as being fed into the transmitters 12 and 14 from the lead 10, it is to be understood that the command signal could be individually fed into each transmitter under varying amplitudes in which case the spirit of the invention is still the same. While FIGS. 1 and 2 show the enemy jammer transmitter 40 jamming the carrier waves transmitted from the launching aircraft 36 it would be feasible for a friendly station to transmit a carrier wave which is identical in frequency to one of the carrier waves transmitted from the launching aircraft 36 merely to enhance the beating operation within the mixer 20. The modulation of the carrier waves may, of course, be either amplitude modulation or frequency modulation.

It is now readily apparent that the present invention provides a simple and efficient way of countering jamming techniques employed by the enemy. By transmitting a command signal over at least a pair of carrier waves, jamming techniques employed by the enemy at either carrier wave will enhance the beating operation of these waves in a mixer at a receiving station, thus increasing the strength of the command signal. Further, since the receiver station beats one carrier wave against the other, the local oscillator and the automatic frquency control circuits are no longer required, thus decreasing the weight and increasing the efficiency of the receiver station.

Obviously, many modifications and variations of the present invention are possible in the light of the above teachings. It is therefor to be understood, that within the scope of the appended claims, the invention may be practiced otherwise than as specifically described.

I claim:

1. A system for avoiding countermeasure jamming techniques comprising:

means for transmitting a signal over at least a pair of carrier waves which differ in frequency by a predetermined amount and means for receiving both carrier waves from the transmitting means and beating the carrier waves against one another to obtain an intermediate frequency wave having an envelope of said signal so as to simulate the operation of a local oscillator and a first detector within a superhetrodyne receiver, whereby jamming either carrier wave will enhance the effect of said beating to increase the amplitude of the signal, thus defeating the purpose of said jamming.

2. A system for controlling a remote station from a command station when countermeasure jamming techniques are effected comprising:

the command station having at least a pair of transmitters operating on carrier wave frequencies which differ from one another by a predetermined frequency;

means for feeding a command signal to each of said transmitters so that each transmitter can transmit the command signal over it's respective carrier wave;

the remote station having means for receiving the carrier waves;

the receiving means having means for beating each carrier wave against the other carrier wave so as to produce an intermediate frequency signal having an envelope of the command signal which can be utilized for command purposes, whereby jamming either carrier wave will enhance the effect of said beating to increase the amplitude of the signal, thus defeating the purpose of said jamming.

3. A system for controlling a remote station from a command station when countermeasure jamming techniques are effected comprising:

the command station having at least a pair of transmitters operating on carrier wave frequencies which differ from one another by a predetermined frequency;

means for feeding a command signal to each of said transmitters so that each transmitter can transmit the command signal over it's respective carrier wave;

whereby the remote station can receive both carrier waves and beat one against the other to obtain a command signal of greater strength when either carrier wave is jammed on it's particular frequency.

4. A method of avoiding countermeasure jamming techniques comprising the steps of:

transmitting a signal over at least a pair of carrier waves which differ in frequency by a predetermined amount and receiving and beating the carrier waves one against the other to obtain an intermediate frequency wave having an envelope of said signal, whereby jamming either carrier wave will enhance the effect of said beating to increase the amplitude of the signal, thus defeating the purpose of said jamming.

5. A method of commanding a remote station comprising the steps of:

generating at least a pair of carrier waves having a predetermined frequency differential;

modulating each carrier wave with a command signal;

transmitting each modulated wave to the remote station;

beating the modulated waves one against the other at the remote station to obtain a predetermined intermediate frequency wave having the envelope of the command signal for command purposes, whereby jamming of one of the modulated waves will increase the amplitude during said beating to increase the output command signal, thereby defeating the purpose of said jamming.

6. A method of increasing the amplitude of a signal which is transmitted from a transmitter station to a receiving station comprising the steps of:

modulating the signal at the transmitter station with at least one of a pair of carrier waves which differ in frequency by a predetermined amount;

transmitting the modulated carrier wave and the other carrier wave to the receiving station;

intermediate said stations transmitting a further carrier wave having the same frequency as said other carrier wave thus increasing the amplitude of said other carrier wave and receiving all of said waves at the receiving station and beating them one against the other to produce an intermediate frequency wave having an envelope of said signal which signal has an increased amplitude.

* * * * *